US005131642A

United States Patent [19]

Yamamoto et al.

[11] Patent Number: 5,131,642

[45] Date of Patent: Jul. 21, 1992

[54] SORTER

[75] Inventors: Hiroshi Yamamoto, Ibaraki; Hiroshi Tobita, Omiya, both of Japan

[73] Assignee: Ikegami Tsushinki Co., Ltd., Tokyo, Japan

[21] Appl. No.: 832,651

[22] Filed: Feb. 11, 1992

Related U.S. Application Data

[63] Continuation of Ser. No. 600,921, Oct. 22, 1990, abandoned.

[30] Foreign Application Priority Data

Oct. 31, 1989 [JP] Japan ..... 1-284194

[51] Int. Cl.[5] ..... B42B 1/02

[52] U.S. Cl. ..... 270/53; 270/52

[58] Field of Search ..... 270/52, 53, 58, 37; 271/287, 292, 293, 294

[56] References Cited

U.S. PATENT DOCUMENTS

| | | | |
|---|---|---|---|
| 4,376,529 | 3/1983 | George et al. . | |
| 4,605,211 | 8/1986 | Sonobe | 270/53 |
| 4,925,171 | 5/1990 | Kramer | 270/53 |
| 4,928,941 | 5/1990 | Uto | 270/53 |

FOREIGN PATENT DOCUMENTS

| | | | |
|---|---|---|---|
| 0301538 | 2/1989 | European Pat. Off. . | |
| 301595 | 2/1989 | European Pat. Off. | 270/53 |
| 2363558 | 7/1974 | Fed. Rep. of Germany . | |
| 61-287663 | 12/1986 | Japan . | |

*Primary Examiner*—Edward K. Look
*Assistant Examiner*—Therese M. Newholm
*Attorney, Agent, or Firm*—Oliff & Berridge

[57] ABSTRACT

A vertically arranged plurality of trays are each formed with a cut-out at a rear corner. The trays are arranged so that the corner where the cut-out is formed is lower than the other corners. Vertically upward extending rear and side walls are provided on each tray adjacent the cut-out. A downwardly extending side wall is formed on the tray opposite the upwardly extending one. The trays can be selectively shifted by cylindrical cams to positions wherein sheets of printed matter can be ejected thereonto. Due to the skewed angle of the trays the sheets slide to the corners where the cut-out are formed. After sheet collation a tray drawing device pulls a tray rearwardly to a stapler which fastens the sheets at the corners which extend into the cut-out. The tray drawing device then returns the tray, the trays are shifted vertically by the cylindrical cams, and the next tray is pulled to the stapler.

18 Claims, 15 Drawing Sheets

SORTER

This is a continuation of application Ser. No. 07/600,921 filed Oct. 22, 1990, now abandoned.

BACKGROUND OF THE INVENTION

1. Field of the Invention

The present invention relates generally to a sorting device for use with copy and printing machines and more specifically to such a sorter which includes a novel collection tray and stapler arrangement.

2. Description of the Prior Art

Sorters which are equipped with staplers are required to firstly sort and accumulate sheets of printed matter in carefully aligned stacks before fastening the same at a predetermined location such as the upper left hand corner.

Various arrangements have been proposed to accomplish the above mentioned alignment and fastening. Arrangements for aligning the sheets prior to the stapling operation have included trays which are provided with slots and movable shafts which extend normally to the tray and which are moved through the slots until such time as the shafts engage the edge of the sheets and push the same across the tray until they engage stoppers provided along one side thereof.

In connection with the stapling devices used in such arrangements, JP-A-61-287663 discloses a proposal wherein the trays above and below the one on which the sheets to be fastened are accumulated, are arranged at relatively large spacings with respect to one another so that a stapler can be moved in between the same and assume a suitable operating position with respect to the accumulated stack of sheets.

However, with the above types of alignment arrangements drawbacks are encountered in that actuators and associated mechanisms are required to move the shafts back and forth along the slots. These devices of course consume relatively large amounts of space and thus tend to undesirably increase the size complexity and attendant cost of the sorter.

Further, the above mentioned types of stapling arrangements are such as to require mechanisms which can locate the stapler at the desired position and subsequently actuate the same. In addition to this, the relatively large spaces must be provided between adjacent trays so as to facilitate the positioning of the stapler induces the problem that the overall height of the sorter is increased and cannot be readily reduced.

SUMMARY OF THE INVENTION

It is an object of the present invention to overcome the above mentioned prior art drawback and provide a sorter which is both compact and relatively inexpensive.

Another object of the present invention is to provide a stapler equipped type sorter which can quickly sort and fasten a plurality of stacks.

A further object of the present invention is to provide a stapler equipped type sorter wherein the trays on which the sheets are accumulated are arranged at small intervals and in a manner which enables the overall height of the sorter to be reduced.

In brief, the above objects are achieved by an arrangement wherein a vertically arranged plurality of trays are each formed with a cut-out at a rear corner. The trays are each arranged so that the corner where the cut-out is formed is lower than the other corners. The trays can be selectively shifted by a shifting mechanism to a position wherein sheets of printed matter can be ejected thereonto. The skewed orientation of the trays causes the sheets to slide under their own weight to the corners where the cut-outs are formed and accumulate in a neat stack.

After sheet collation a tray drawing device pulls a first tray rearwardly to a stapler which fastens the sheets together. The tray drawing device then returns the first tray, the trays are shifted vertically and the next tray is tracted to the stapler.

A first feature of the present invention comes in a sorter which has a vertically movable array of trays which each have a cut-out formed a selected corner, an arrangement for moving the trays to a position in which sheets can be ejected thereronto and holding them in the position while sheets are being ejected, and a stapler for fixing the collated sheets together and which is characterized in that the cut out portions of the trays are moved one by one to the stapler.

A second feature of the invention comes in the arrangement wherein the trays have a skewed orientation wherein the corners of the trays in which the cut-outs are formed are lower than the other corners. As a result, the sheets which are ejected onto the trays fall under their own weight toward the cut-out corner and collect against a rear wall and side wall which flank the cut-out.

A third feature of the invention comes in that the sorter according to the present invention features a low profile, compact, simple and therefore inexpensive and further inherently permits quick sorting and fastening.

A further feature is that the unique tray orientation permits the sorter to automatically stack sheets ready for fastening irrespective of sheet size.

Another feature of the invention is that the stapler does not move and trays are one by one tracted to the device. This also facilitates the ready loading of the staples into the stapler.

More specifically a first aspect of the present invention comes in a sorter comprises:

a plurality of trays arranged one above the other, the trays each having an end wall and a first side wall which extend upwardly from the rear and first side edges thereof, the trays each being oriented so that the corner in which a cut-out is formed is lower than the other corners of the tray;

means for shifting the trays and for maintaining the same in a predetermined configuration after each shift;

means for ejecting sheets onto the trays; and stapler means for fastening the sheets which are collected on the trays.

Here, each of the trays further may comprise a second side wall which extends downwardly from a second side edge thereof, the second side wall having a height which is greater than that of the first side wall.

The first and second side walls may have leading and trailing ends respectively, and wherein the second side wall has horizontally extending guide pins located proximate the leading and trailing ends respectively, and wherein the first side wall has a guide pin located proximate the trailing end.

A second aspect of the present invention comes in a sorter comprising:

a plurality of trays which are arranged in a vertically array which can be selectively shifted to and maintained in a predetermined position wherein sheets can be received;

means for ejecting sheets onto the tray in the predetermined position;

means for fastening stacks of sheets which have accumulated on the trays; and means for selectively drawing one of the plurality of trays to an operative position with respect to the fastening means.

Here, the fastening means may comprise a stapler.

Each of the trays may comprise:

a cut-out formed in a corner of the tray;

a rear wall which extends up at a rear edge of the tray and which terminates at the cut-out;

a first side wall which extends up at a first side edge of the tray, which is perpendicular to the rear wall and which terminates at the cut-out, and wherein each of the trays is oriented in a manner wherein the corner in which the cut-out is formed is lower than the other corners thereof.

A sorter may further comprise a second side wall which extends from a second side edge of each tray, the second side wall having a height which is greater than the first side wall and extending in a direction which is opposite to the direction in which the first side wall extends, the first and second side walls having horizontally extending guide pins which extend from rear portions thereof, the second side wall having a second horizontally extending guide pin proximate a forward portion thereof.

A sorter may further comprise:

a frame member;

vertically extending guide slots in the frame, the guide slots reciprocatively receiving the guide pins which extend from the rear portions of the first and second side walls;

first and second vertically extending shafts which are rotatably supported on the frame member;

first and second cams in which helical grooves are formed, the first and second cams being respectively mounted on the first and second shafts and arranged so that the guide pins which extend from the rear portions of the first and second side walls can be operatively engaged in the helical grooves; and means for driving the first and second cams in opposite rotational directions.

The guide pin which extends from the rear portion of the second guide wall may be located proximate the lower edge thereof, and the first and second cams may be arranged at different heights.

A sorter may further comprise a transfer roller and a pinch roller, the transfer roller and pinch roller being rotatably supported on first transfer roller shaft and a pinch roller shaft respectively, the transfer roller shaft and the pinch roller shaft being arranged to extend laterally across the frame member at a predetermined angle with respect to the horizontal.

Here, the tray drawing means may comprise:

a frame member formed with a branch slot which merges with a vertically extending guide slot;

a guide rail which is mounted on the frame member in a predetermined relationship with the branch slot;

a slider arrangement which is reciprocatively recieved in the guide rail and arranged to engage a selected one of a plurality of guide pins which are formed on the plurality of trays respectively; and means for moving the slider along the guide rail.

The tray drawing means may comprise:

a branch slot which is formed in the frame member and which merges with the vertically extending guide slot and which is arranged at a predetermined angle;

a guide rail which is supported on the frame member and which is arranged in a predetermined relationship with respect to the branch slot;

a slider which is reciprocatively disposed in the guide rail and engageable with the guide pins which are reciprocatively received in the guide slot;

means for moving the slider along the guide slot.

The first and second cams may have a cylindrical configuration and may be each formed with a helical grooves which winds about the periphery of the cam twice, the lower first winding of each groove having the same inclination as the angle at which the branch slot merges with the vertically extending guide slot.

An extrapolation of the axis of the branch groove may extend to an entrance of the stapler.

The slider moving means may comprise:

a crank wheel;

a link which is pivotally connected at a first end to the crank wheel and at a second end to the slider arrangement.

In the third aspect of the present invention, a sorter comprises:

a plurality of trays which are arranged one above the other and which are vertically displaceable, each of the trays including:

a rear wall, a first side wall, a cut-out formed at the corner toward which the rear and first side wall extend, a second side wall which has a height greater than that of the first side wall and which extends in a direction opposite that of the first side wall, first and second horizontally extending guide pins, the first guide pin being arranged to project from the first side wall at location proximate a rear edge thereof and proximate the cut-out, the second pin extending from the second side wall at locations proximate a rear edge thereof, first and second guide flanges, formed on the first and second side walls respectively, and first and second shift pins slidably mounted to the first and second guide flanges;

a frame member, the frame member being formed with:

a pair of first guide guide slots which are essentially vertical and in which the guide pins are received, a pair of branch slot which merges with the first guide slots at a predetermined angle, and a pair of second guide slots which are essentially vertical and in which the shift pins are received;

first and second cylindrical cams respectively mounted on first and second vertical shafts, the first and second vertical shafts being rotatably mounted on the frame member, the first and second cylindrical cams being formed with helical grooves in which the shift pins can engage;

a pair of groups rails disposed on the frame member in a predetermined relationship with the branch slots;

a pair of sliders disposed in the guide rails, the sliders being formed with means for engaging the tray pins; and means for selectively moving the sliders along the guide rails.

Here, the means for selectively moving the slider may comprise:

a crankwheel; and a link operatively interconnecting the slider and the crankwheel.

a sorter may further comprise a stapler, the stapler having an entrance which is located on an extrapolation of the branch slot.

A further aspect of the present invention comes in a sorter comprising:

a plurality of trays which are arranged one above the other and which are vertically displaceable, each of the trays including:

a rear wall, a first side wall, a cut-out formed at the corner toward which the rear and first side wall extend, a downwardly extending second side wall which has a height greater than that of the first side wall, first and second horizontally extending tray pins, the first tray pin being arranged to project from the first side wall at location proximate a rear edge thereof and proximate the cut-out, the second pin extending from the second side wall at locations proximate a rear edge thereof, first and second spacers, the spacers being formed with vertical extending grooves and holes through which the first and second tray pins are received;

a frame member, the frame member being formed with:

a pair of first guide slots which are essentially vertical and in which the tray pins are received, and a pair of branch slots which merge with the first guide slots at a predetermined angle;

first and second cylindrical cams respectively mounted on first and second vertical shafts, the first and second vertical shafts being rotatably mounted on the frame member, the first and second cylindrical cams being formed with helical grooves in which the tray pins can engage;

a pair of guide rails disposed on the frame member in a predetermined relationship with the branch slots;

a pair of slide members which are formed with hook portions and which are reciprocatively received in the guide rails, the hook portions being arrange to be engageable with the vertical extending grooves formed in the spacers; and means for moving the slide members along the guide rails.

Here, the slider member moving means may comprise:

a crankwheel; and a link operatively interconnecting the crankwheel and the slide member.

A sorter may further comprise a stapler, the stapler having an entrance which is located on an extrapolation of the branch slot.

The above and other objects, effects, features and advantages of the present invention will become more apparent from the following description of embodiments thereof taken in conjuction with the accompanying drawings.

DETAILED DESCRIPTION OF PREFERRED EMBODIMENTS

Figure 1:
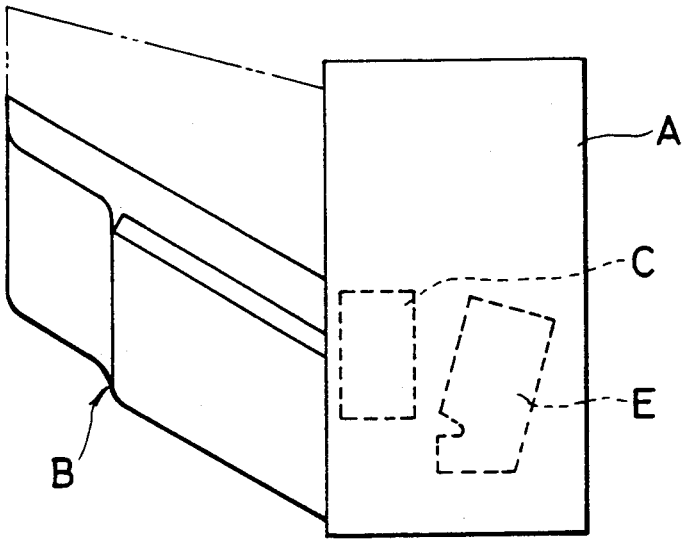
FIGS. 1 to 3 are simplified views showing the outline of a sorter according to a first embodiment of the present invention as seen in side elevation, front elevation and plan, respectively.
Figure 2:
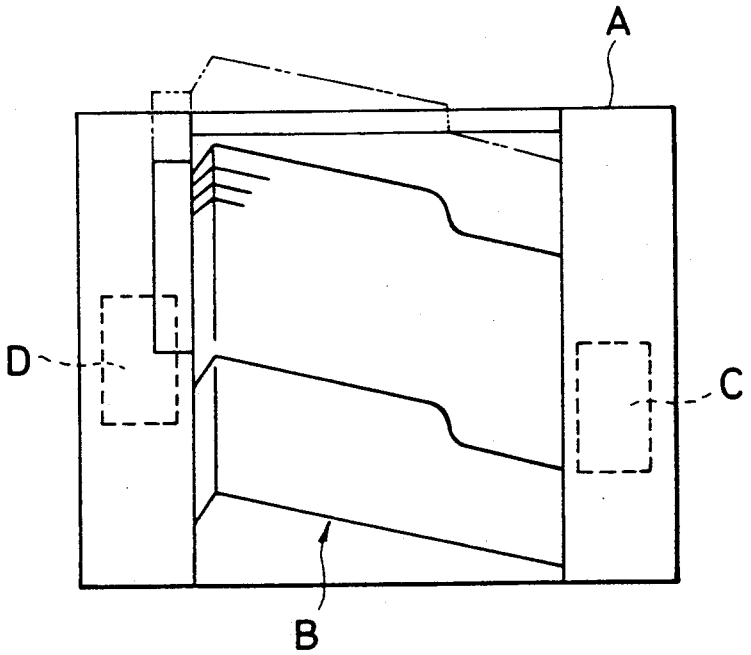
Figure 3:
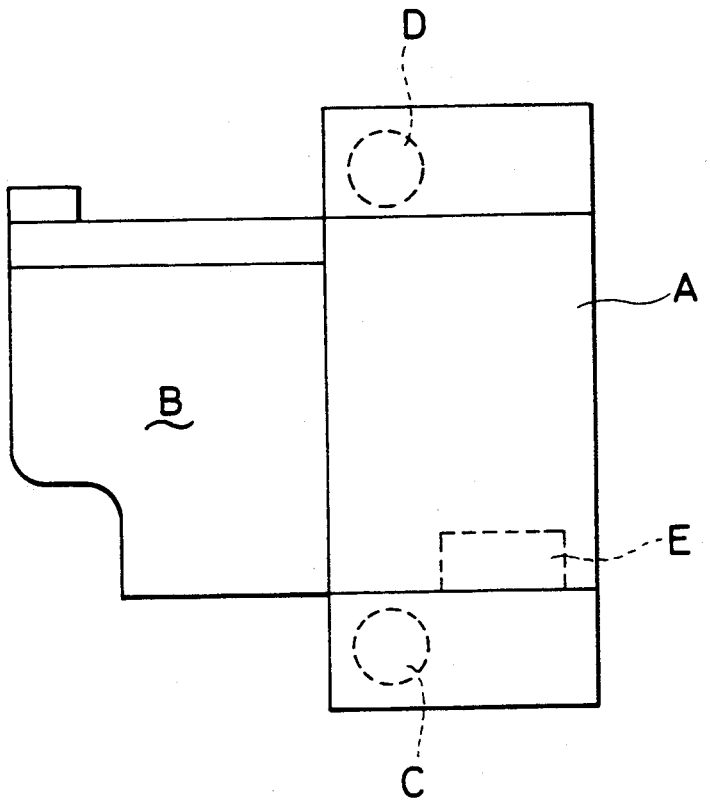

FIGS. 1–8 show the construction and arrangement of a first embodiment of the present invention. Prior to a detailed description of the construction and arrangement of the first embodiment it is deemed advantageous to consider the basic configuration and arrangement of the same. Referring now to FIGS. 1 to 3, a main casing A is provided with a plurality of trays B which project out from the main casing A and which can be moved vertically up and down with respect to the same. In these figures C and D represent mechanisms which are located at each end of the trays and which include cylindrical cams via which the trays can be shifted one by one and maintained in a condition suitable for sheet ejection. E denotes a fastening device or stapler as it will be referred to hereinafter.

Figure 4:
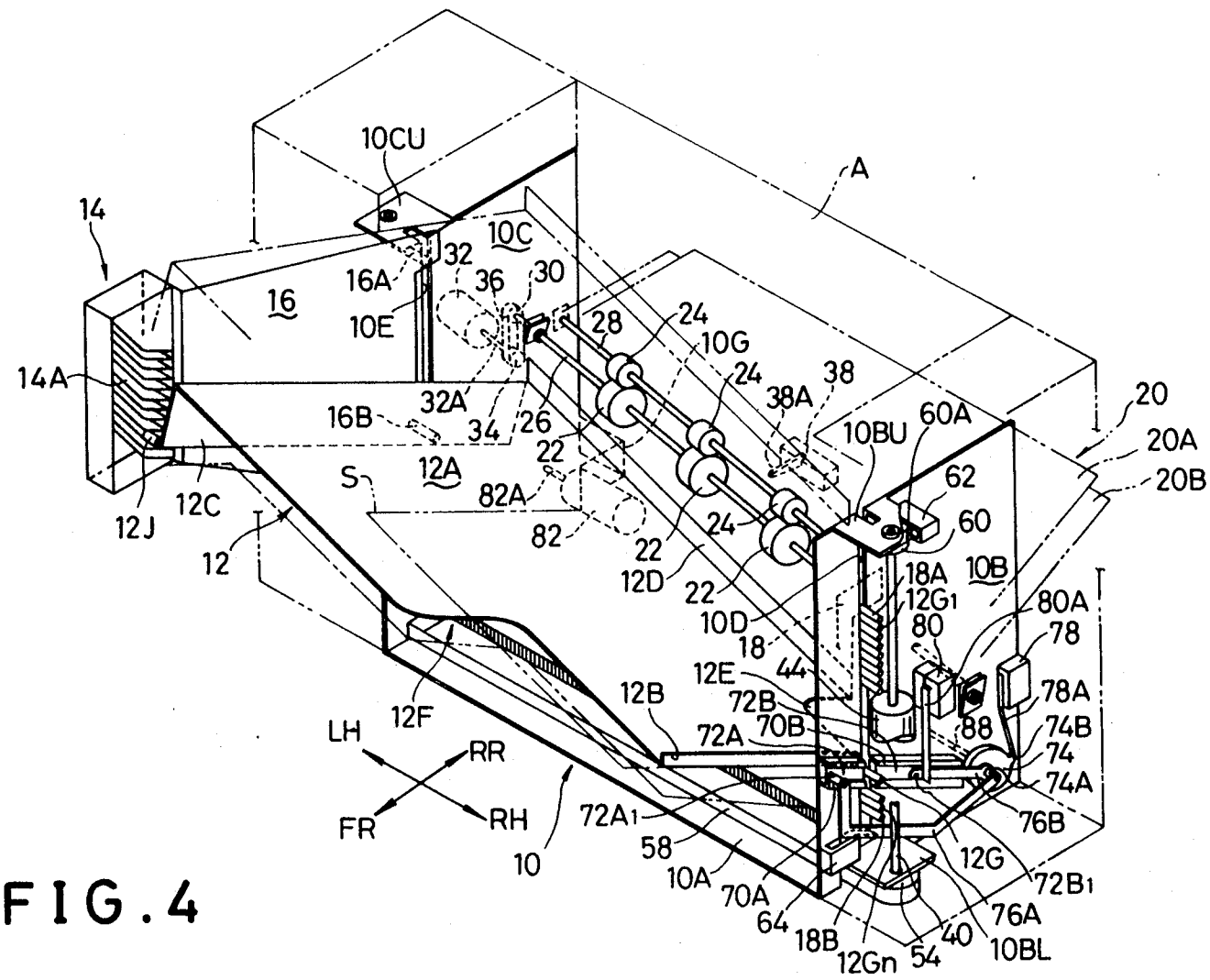
FIG. 4 is a perspective view showing the manner in which the various working components of the first embodiment are arranged with respect to one another.

FIG. 4 shows details of the construction and arrangement of the first embodiment. In this figure the arrows FR, RR, RH and LH respectively denote the direction of the front, rear, right and left sides of the sorter.

The main frame 10 of the main casing A is such as to comprises a bottom frame 10A, two side frames 10B, 10C which extend vertically upward from each side of the bottom frame 10A. The side frames 10B and 10C are respectively formed with vertical guide slots 10D and 10E.

Figure 5:
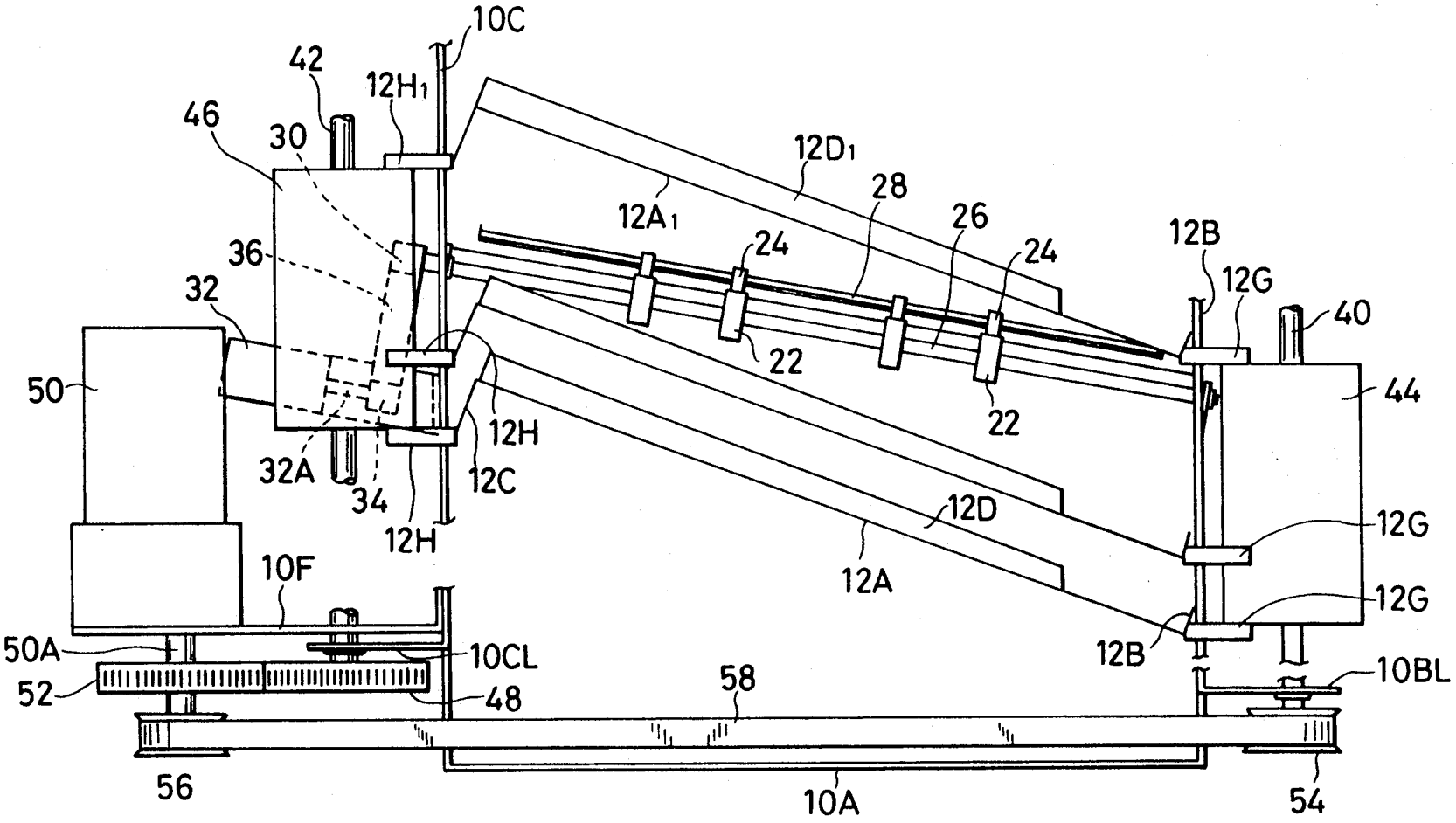
FIG. 5 is a view showing further constructional features of the first embodiment.
Figure 12:
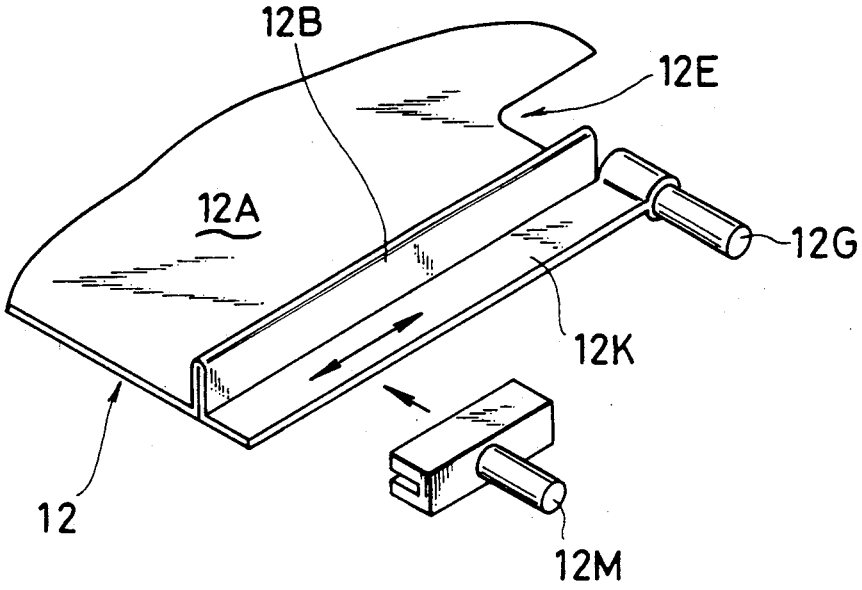
FIG. 12 is a view which shows a part of a trays used in the first embodiment.

In this figure 12 denotes the trays B. In this instance $\mathbf{12}_1$–$\mathbf{12}n$ trays are arranged one above the other in a vertical stack in a manner to be each movable with respect to one another. It will be noted that in FIG. 1 only one tray 12 is illustrated for simplicity. As best seen in FIGS. 4 and 5, the trays are constructed in a manner to have a lower wall or base 12A, and integral vertically extending walls 12B, 12C and 12D. The walls 12B and 12D project up normally from the right and rear edges of the lower wall 12A while the side wall 12C projects at right angles downwardly from the left edge of 12A. The side wall 12C has a greater vertical dimension than the walls 12B and 12D.

As the trays 12 are formed with the side walls 12B and 12C, they exhibit an increased structural rigidity which allows for the thickness of the same to be reduced.

The right rear corner of each tray is formed with a cut-out 12E which permits the stapler to be moved into an operative position with respect to the sheets which are accumulated thereon.

The front right corner of each of the trays is formed with a cut-out 12F which facilitates manual removal of the sheets.

The side walls 12B and 12D are formed with horizontal tray pins 12G and 12H which are slidably received in the previously mentioned guide slots 10D and 10E, respectively.

A horizontally extending tray pin 12J is formed the fowward lower corner of each of the side walls 12C. These pins 12J are arranged to be received in a front guide member 14.

In this embodiment the front guide member 14 is supported by a left carrier side plate on which are formed guide pins 16A and 16B operatively engaged with the left guide slot 10E. The front guide member 14 formed with a plurality of guide grooves 14A (14A$_1$–14A$n$) corresponding in number to the n number of trays 12.

Tray pins 12H$_1$–12H$n$ which are provided on the left hand side of the trays 12 are accommodated in the guide slot 10E between guide pins 16A and 16B which are formed on a vertically movable left carrier side plate 16.

On the other hand, a vertically movable right carrier side plate 18 is disposed on the right side of the device and provided with guide pins 18A and 18B. The guide pins 18A and 18B are received in the guide slot 10D at locations above and below the tray pins 12G (12G$_1$–12G$n$).

SHEET TRANSFER MECHANISM

The sheet transfer mechanism utilized in this embodiment comprises laterally extending guide plate 20A and 20B which are fixedly connected with the main frame 10, and arranged one above the other at a predetermined spacing in a manner to define an incoming sheet transfer guide 20. This transfer guide 20 has a inlet which is positioned in a manner to receive sheets from a non-illustrated copy or printing machine, and an outlet adjacent which a transfer roller 22 and a corresponding pinch roller 24 are disposed. The transfer roller 22 and the pinch roller 24 are rotatably supported on the right side frame 10B and the left side frame 10C, by way of shafts 26 and 28, respectively. The shifts 26, 28 are arranged at a predetermined inclination with respect to the horizontal as clearly shown in FIG. 5. The trays 12 are arranged at a corresponding angle and thus enables the overall height of the main casing to be reduced. The transfer roller shaft 26 ahs a pulley 30 fixedly connected thereto. A motor 32 which is mounted on left side frame 10C, has an output shaft 32A on which a pulley 34 is mounted. A drive belt 36 establishes a drive connection between the pulleys 30, 34.

It should be noted that a sheet sensor 38 is mounted on the lower side of the guide plate 20B. This sensor 38 includes a detection lever 38A which is arranged to project into the transfer guide 20.

The mechanism which permits the trays 12 to be shifted one by one in a manner which enables the sheets accummulated thereon comprises a vertical shaft 40 which is rotatably supported on flanges 10BU and 10BL formed at the top and bottom of the side frame 10B. A corresponding vertical shaft 42 is rotatably supported on flanges 10CU and 10CL formed at the top and bottom of the side frame 10C. These vertical shafts 40, 42 have cylindrical cams 44, 46 fixedly connected thereto.

As shown in FIG. 2 and 5, these cams are arranged at different heights (note that the cams are denoted by C and D in FIG. 2).

Figure 8:
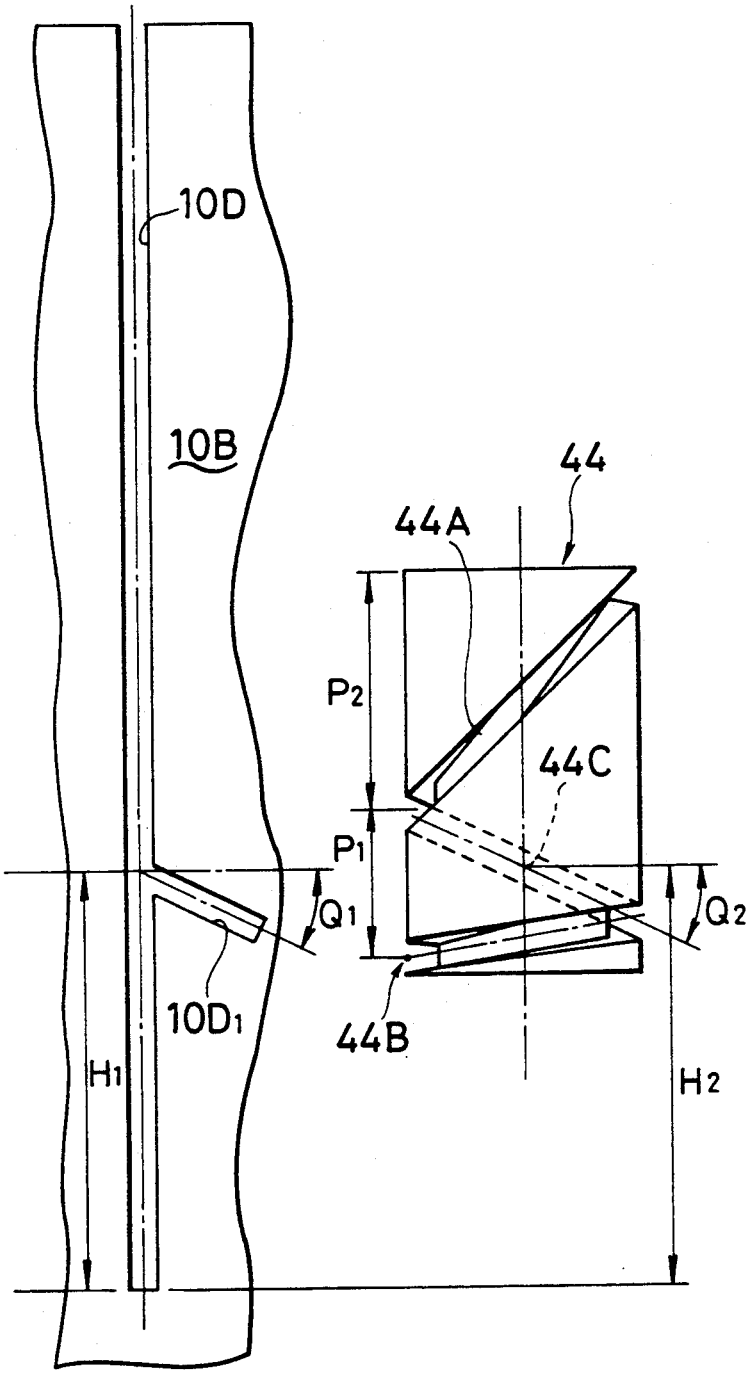
FIG. 8 is a view showing the relationship between a forked slot and a circular cam arrangement which characterizes the construction of the first embodiment.

The cam 44 on the right is formed with a helical groove 44A which winds twice its outer periphery (see FIG. 8). The cam 46 on the left is also formed with a helical groove 46A which winds twice about the periphery. However, in this latter case, the groove 46A is formed in a manner that it threads or winds in the opposite direction to that of groove 44A.

The tray pins 12G and 12H are arranged to be operatively received in the helical grooves 44A and 46A. As the cams are arranged at differenct heights the trays 12 are induced to slant both toward the lower right and rearwardly downwrd in a manner which lowers the cut-out 12E ot a minimum height and holds the same in this position (viz., the trays are oriented at a skewed angle).

The left vertical shaft 42 is provided with a gear 48 at the bottom thereof. This gear is meshed with a gear 52 which is carried on the output shaft 50A of a motor 50. The motor 50 is supported on a bracket 10F fixed to the left side plate 10C.

On the other hand, the lower end of the vertical shaft 40 is provided with a cogged pulley 54 which is placed in drive connection with a cogged pulley 56 mounted on the drive shaft 50A adjacent the gear 52, by way of a timing belt 58.

As will be appreciated, with this arrangement the shafts 40, 42 are induced to undergo simultaneous rotation but in reverse rotational directions.

In accordance with the reverse rotation of the cams 44 and 46 and the reverse directions in which the helical grooves 44A and 46A are formed, after the cams undergo two full rotations, the tray pins which are inducted at the bottom of the grooves will have been moved through the grooves to the top of the respective cam.

A cam 60 is provided at the top of the vertical shaft 40. This cam 60 includes a projection 60A which triggers a switch 62 mounted opposite the same on the side frame 10B and is arranged to detect the cam 44 assuming a position in which the rotation of the same should be stopped.

A lower limit switch 64 is mounted on the side frame 10B proximate the bottom of the slot 10D and arranged so that when the pins 12G$_1$ and 12H$_1$ have passed down through the helical grooves 44A and 46A of the cylindrical cams 44, 46 respectively, the guide pins 18B triggers the same.

The tray draw mechanism which is used to move a selected tray to a position in which fastening or stapling can be carried out will now be described. This description will be made ignoring the fact that the heights at which the side frames 10B and 10C are connected to mechanisms, are different, and taking one side as being typical of the arrangement provided on both sides.

As shown in FIG. 8, at a height $H_1$ above the bottom of the slot 10D a branch slot 10D$_1$ is arranged at a predetermined angle of $Q_1$. The end of this slot is arranged to assume a predetermined position with the helical groove 44A formed in the cylindrical cam 44. As will be appreciated, this groove 44A has two different pitches $P_1$ and $P_2$, the first pitch P1 is such that an angle $Q_2$ which is equal to the ngle Q1 is defined. Further, the lower opening 44B of the helical groove is arranged to be set so that after a pin follows the groove about $\frac{3}{4}$ of the periphery of the cam, it reaches point 44C which is located at a height of H2. In this case H1=H2.

Figure 6:
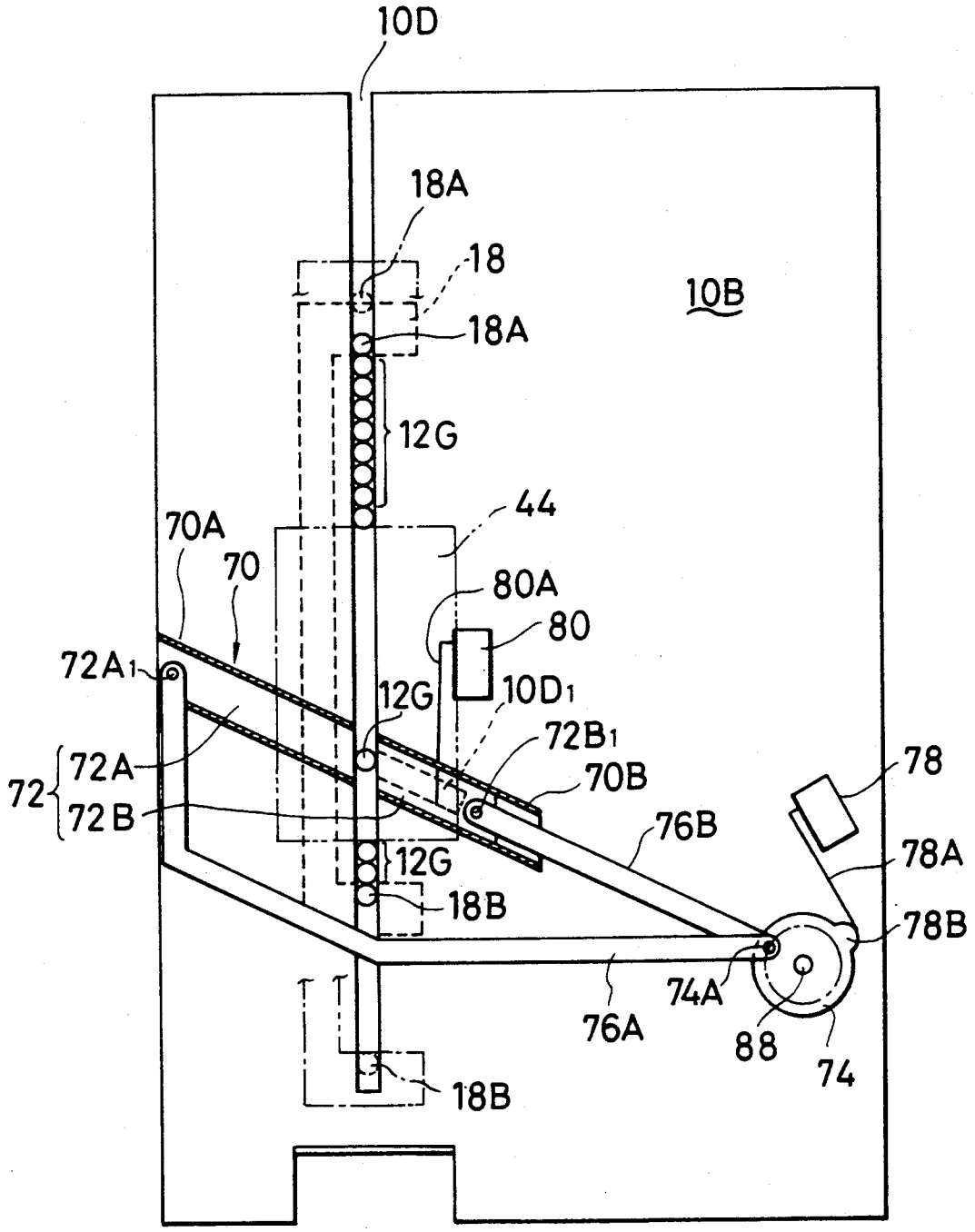
FIG. 6 is a side elevation of the first embodiment.

A slide rail 70 is provided on the external surface of the side frames 10B at an angle Q1 and arranged to enclose the slot 10D1. As best seen in FIG. 6 the slide rail 70 comprises first and second sections 70A and 70B which are divided by the slot 10D in the illustrative manner. A slider arrangement 72 is reciprocatively received in the slide rail 70. In this case the slider arrangement comprises first and second sliders 72A, 72B which are respectively received in the first and second sections 70A, 70B of the slode rail 70. As shown in FIG. 6, the inboard ends of the two sliders 72A and 72B are spaced by a distance which is the same as the width of the slot 10D.

A crank wheel 74 is mounted on the side frame 10B so that the center of rotation lies on an extension of the axis of the slide rail 70. Links 76A and 76B interconnect the crank wheel and the first and second sliders 72A and 72B respectively. The first link 76A is connected on one end to the crank wheel 74 by way of a crank pin 74A and at the other end to the slider 72A by way of pin 72A1. On the other hand, the second link 76B is connected to crank wheel by the aforementioned pin 74A and to the second slider 72B by way of pin 72B1. With this arrangement the first and second sliders 72A and 72B are induced to reciprocate in unison in response to the rotation of the crank wheel 74.

A switch 78 is mounted on the side plate proximate the crank wheel 74. The crank wheel 74 is provided with a projection 78B which engages a switch lever 78A, when the wheel assumes a predetemined position such as illustrated in FIG. 6.

A switch 80 is mounte don the side frame 10B and arranged to detect a predetermined amount of movement of the slider arrangement 72. The switch is triggered by a lever 80A which is arranged in the illustraqted position when a tray pin 12G contacts the leverl 80A.

Figure 7:
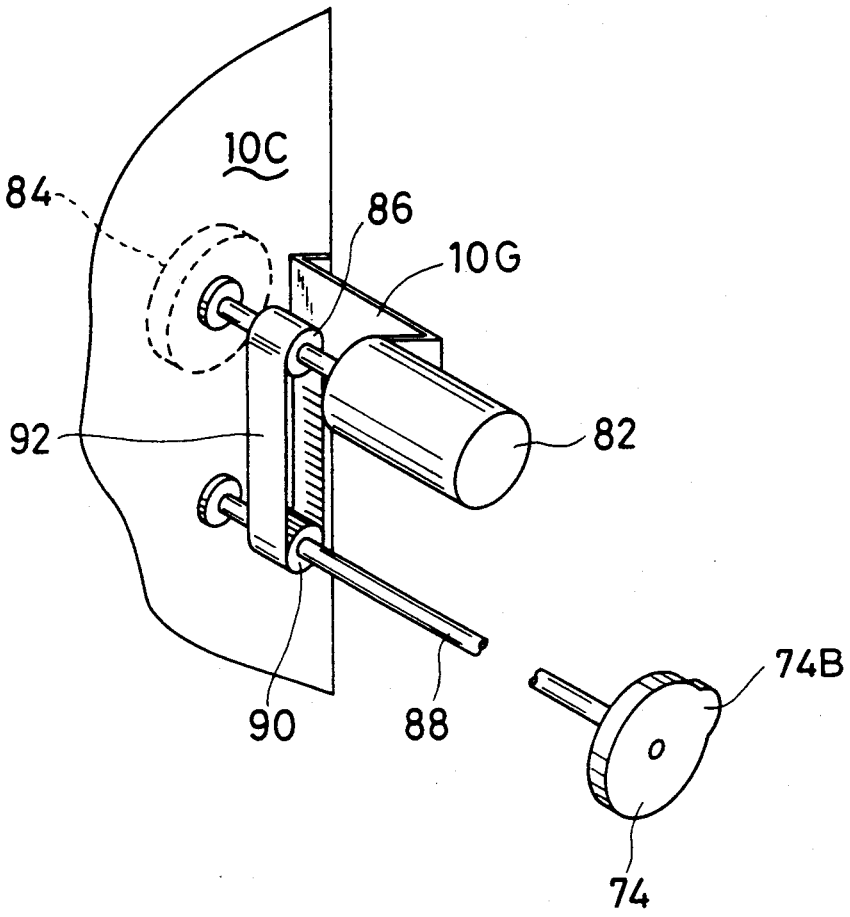
FIG. 7 is a perspective view showing a crank wheel actuator arrangement used in the first embodiment of the present invention.

Referring now to FIGS. 4 and 7, a motor 82 is supported on the side frame 10C by way of a bracket 10G. The output shaft 82A of the motor is rotatably supported by the side frame 10C. The end of the output shaft 82A is connected to a crank wheel 84. A cogged pulley 86 is mounted on the output shaft 82A at a location intermediate of its ends. A connection shaft 88 which extends laterally between the side frames 10B and 10C and on which the crank wheel 74 is mounted, has a cogged pulley 90 mounted thereon. A timing belt 92 provides a drive connection between the pulleys 86, 90.

OPERATION

The operation of the above described first embodiment is as follows:

1. Sorting

A control unit (not shown) which includes a microprocessor, receives data from the associated host copy or printing machine indicative the number of stacks the sheets must be divided into, the number of sheets for each stack, etc. In response to this information the motor 50 is energized and the cylindrical cams 44, 46 induces to rotate in opposite directions. The tray pins 12G, 12H which are engaged in the helical grooves 44A and 46A respectively, are induced to move downwardly in a manner whereby the uppermost tray $12_1$ is moved to juxtapose the outlet opening of the transfer guide 20. This includes what shall be referred to as initial tray setting. In this condition the lower limit switch 64 is triggered by the guide pin 18B and a counter included in the control unit is reset zero.

A copied/printed sheet is introduced into the transfer guide 20 and the motor 30 energized in a manner to drive the transfer and pinch rollers 22, 24. Due to the inclination of the trays, the sheets which are discharged onto the tray 12 smoothly stack against the right rear walls 12B, 12D in the manner indicated by S in FIG. 4.

When a sheet passes through the transfer guide 20, the sensor 38 detect the passage. In response to this detection, the motor 50 is energized in a manner which induces the cylindrical cams 44, 46 to rotate in directions which cause the upper tray to be shifted upwardly.

Figure 9:
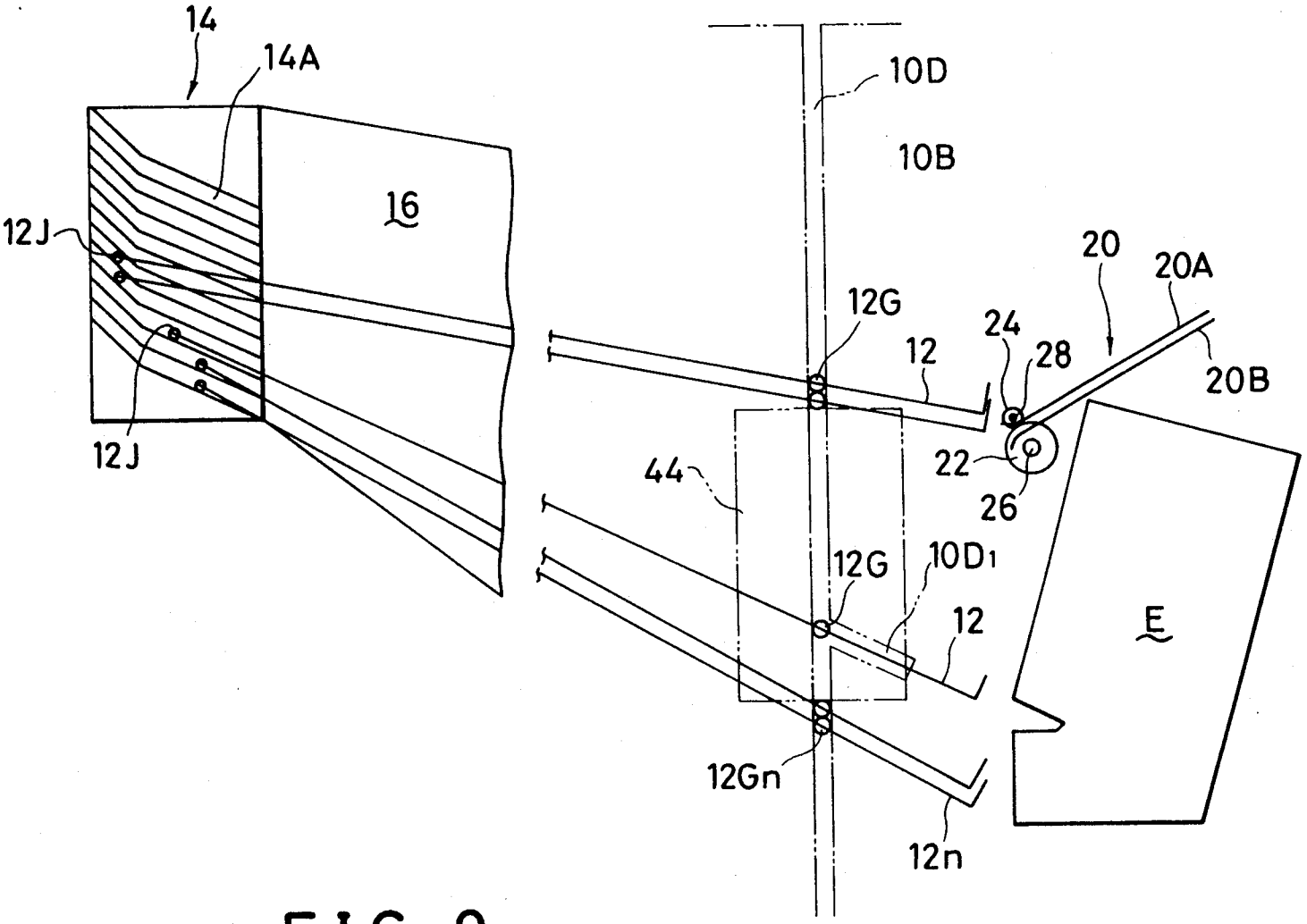
FIGS. 9 and 11 are views which illustrate two stages of the operation of the first embodiment.
Figure 10:
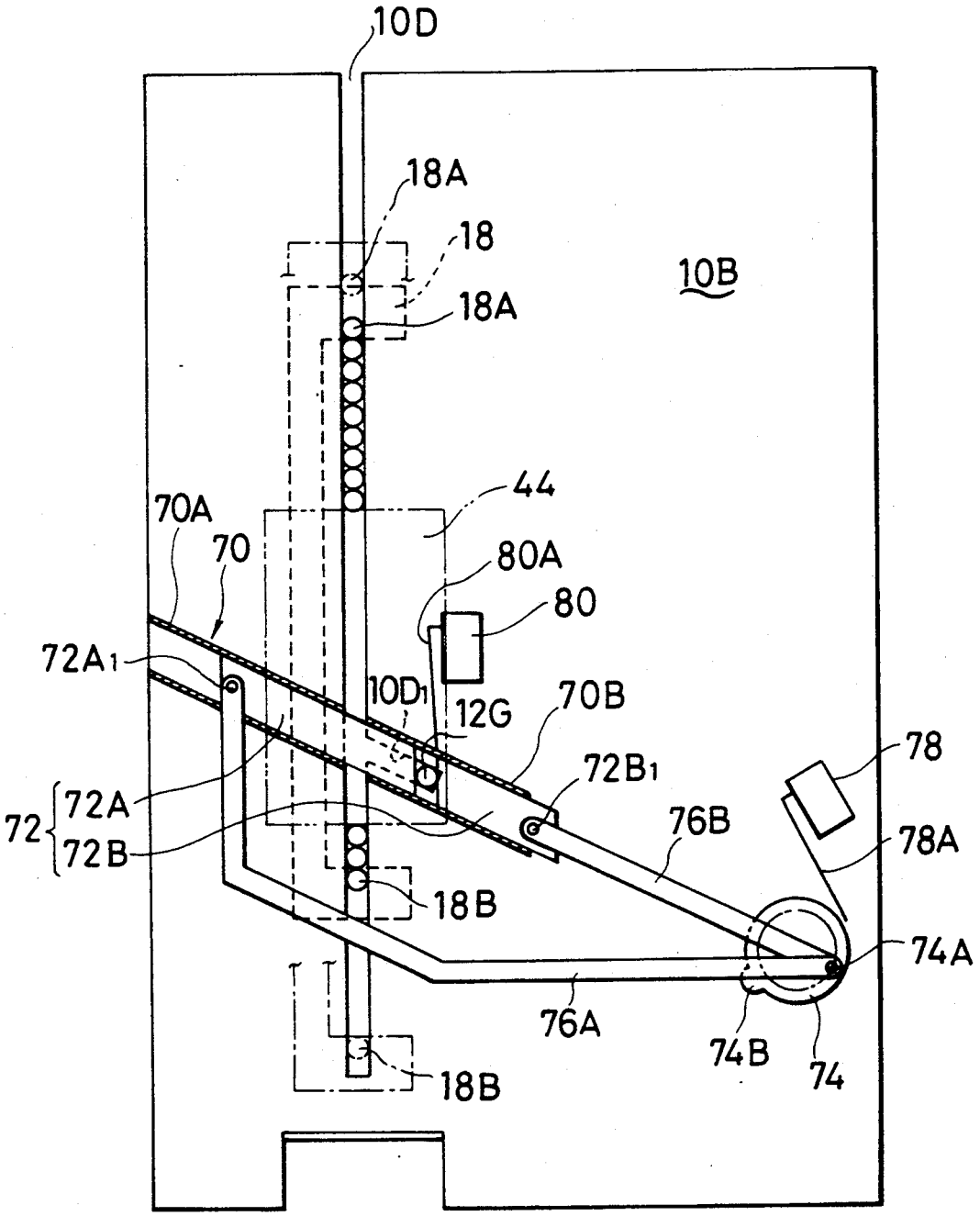
FIG. 10 is a side elevation depicting the operation of the first embodiment.

This results in the tray pins $12G_1$ and $12H_1$ being respectively maintained at the tops of the cylindrical cams 44, 46 and the situation wherein the tray pins $12G_2$ and $12H_2$ are picked up and moved partially along the helical grooves 44A, 46A (see FIG. 9 for an example of this situation).

Following this shift, a corresponding sheet is ejected into the second tray.

It will be appreciated that during this shift operation, as the pins 12G and 12H of the succeeding tray are moved upwardly, the tray pins 12J which are received in the guide grooves 14A of the front guide member 14 are also moved upward. As shown in FIG. 9, the front portion of the groove 14A is steeper than the rear portion therof so that a large gap formed between the trays is obtained. This spreads the trays and very notable increases the space between the tray into which sheet ejection is being made and the previous one.

When the desired number of the instant page have been sorted into the respective trays, the motor 50 is reversed and the trays returned to the initial setting and the process is repeated for the next page of the document.

When the sorting process is completed and all of the pages have been collated into the trays, stapling is carried out.

2. Stapling

When the trays have been returned to their initial setting or positions, the lower limit switch 64 is triggered and the control unit counter is clear and reset to zero. As the cylindrical cams 44, 46 complete each rotation the projection 60A triggers the switch 62. This indicates that the pins 12G, 12H of a tray have assumed a position which coincides with the intersection of the axes of the slots 10D and 10D1 and a situation of the nature illustrated in FIG. 6 occurs.

Motor 82 is energized in response to a signal which is issued by the control unit. This rotates the crank wheel 74 and moves the projection 74B in a manner which permits the lever 78A to move to a position in which switch 78 assumes an ON state. Under these conditions the crank wheel 74 and the corresponding unit (84) located on the other side of the sorter rotate. In response to this rotation, the sliders 72A, 72B are tracted by the links 76A and 76B in a manner to sandwich the tray pins 12G(H) therebetween and draw the same down along the slots 10D1(10E1). Tray pin 12G engages the lever 80A and triggers switch 80. This stops the operation of the motor 82 and stops the crank wheels 74(84) after 180 degrees of rotation.

Figure 11:
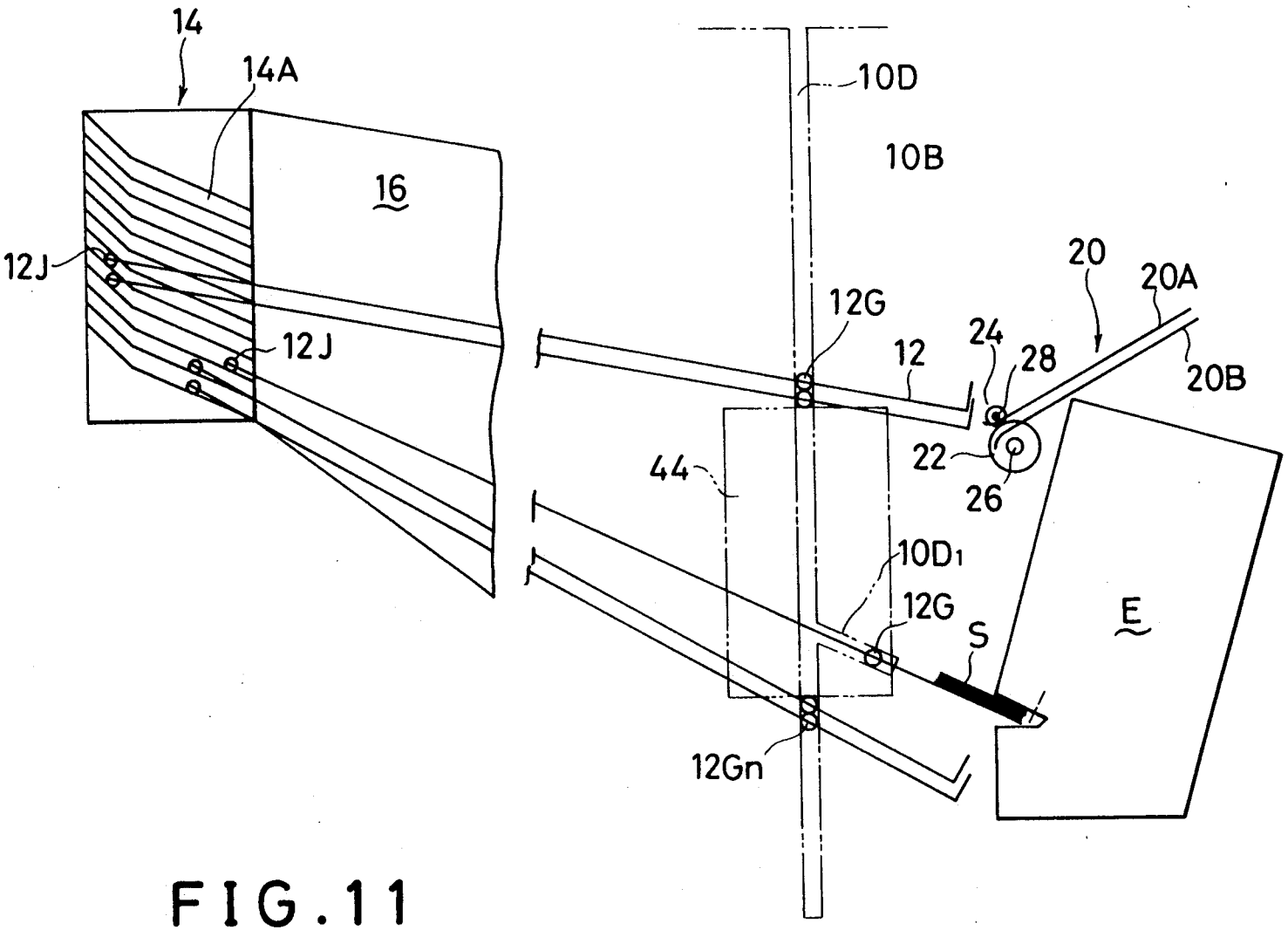

This induces the situation shown in FIG.S 10 and 11. As will be appreciated from FIG. 11 the tray which has been drawn rearwardly is located such that the cut-out 12E is moved to a position immediately proximate the stapling device E and so that the corner of the stack of sheets thereon is located in the mouth of the stapler. The stapler is arranged to perform a stapling operation in response to the triggering of the switch 80.

In this embodiment the stapler may take the form of an electrically operated O.E.M. Standard Model #69031 or O.E.M. Wide Gap Model #69035 manufactured by the Swingline Company of the United States.

After the stapler E is operated the motor 82 is again energized and the crank wheel 74 is again rotated through 180 degrees. This returns the tray to the position shown in FIG. 6 for example. Following this the trays are shifted, the next tray retracted and the stack of sheets thereon stapled.

SECOND EMBODIMENT

Figure 13:
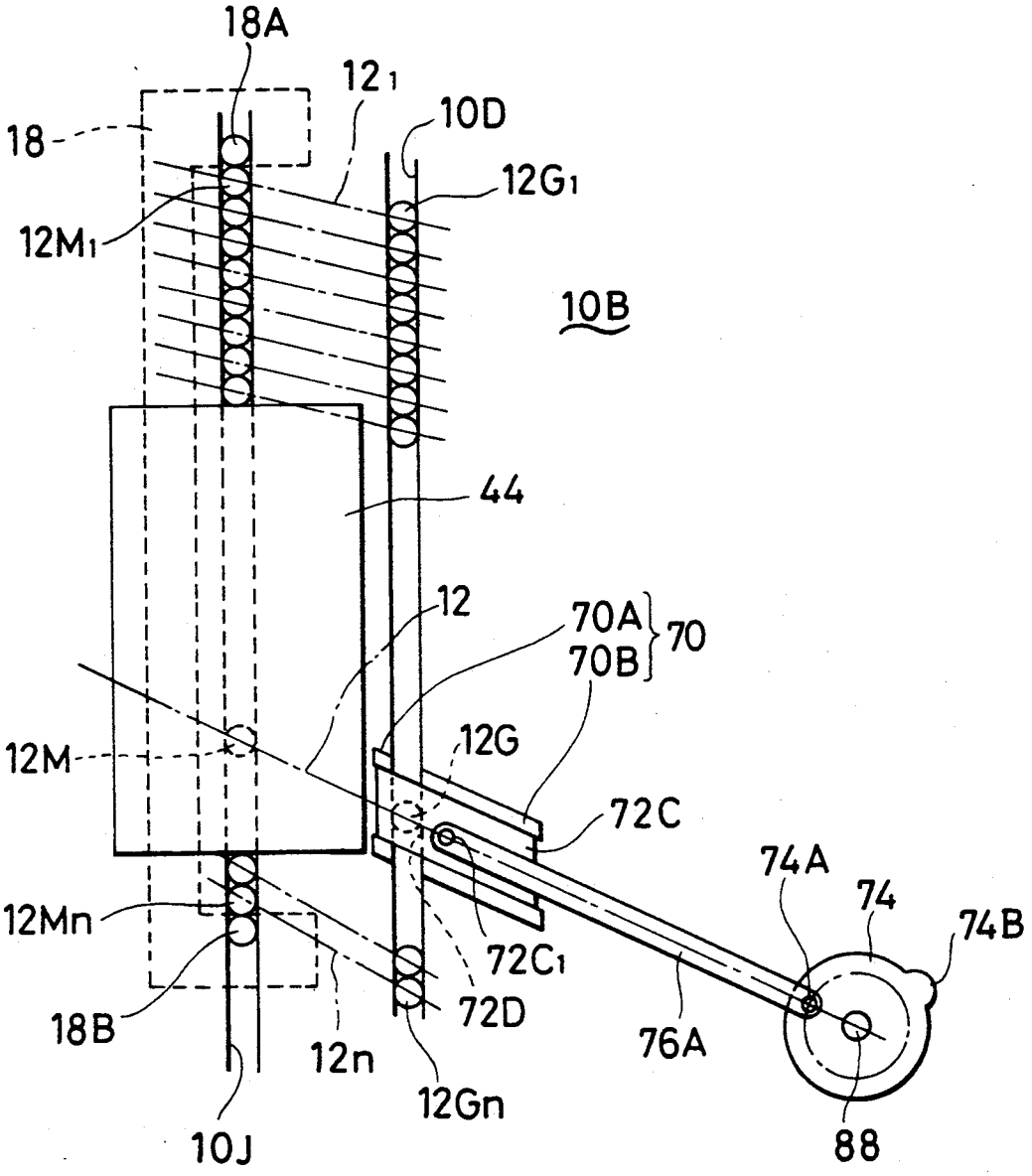
FIGS. 13 and 14 are views which show the construction and operation of a second embodiment of the present invention.
Figure 14:
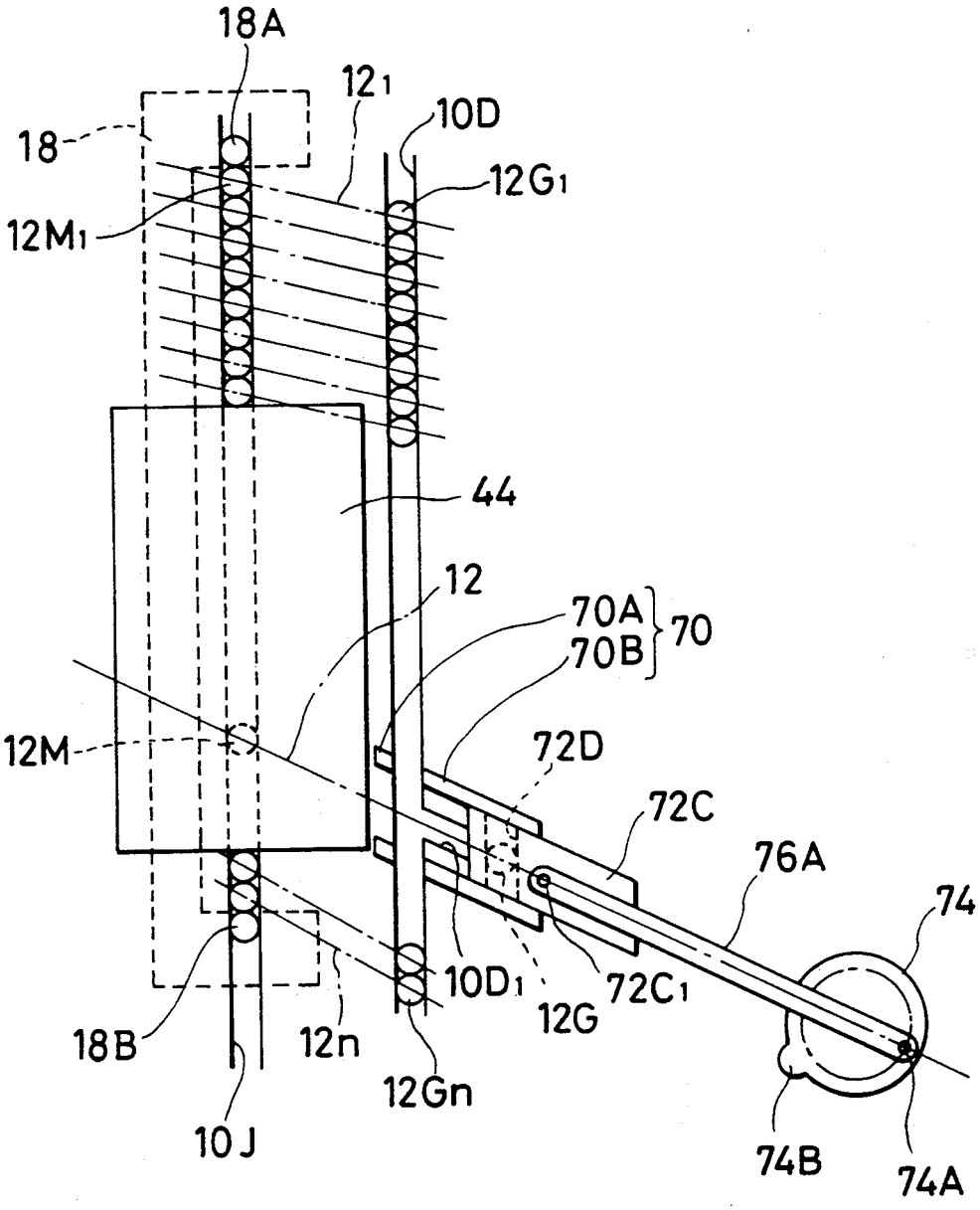

FIGS. 12 to 14 show a second embodiment of the present invention. In this embodiment the tray withdrdawing mechanism is simplified. It will be noted that numerals used in connection with the first embodiment are used to denote like parts in this embodiment and that a redundant explanation of the same has been omitted for brevity.

FIG. 12 shows a guide flange 12K which is formed in a manner to project laterally outward from the right side wall 12B. A corresponding guide flange 12K is formed in a corresponding manner on the left side wall. It will be noted that the numerals which are quoted in brackets are not shown in the drawings and correspond to the elements which are located on the left side of the tray.

Guide flange 12K (and corresponding guide flange 12L which is formed on the lowermost portion of the left side wall 12C) are arranged to guide reciprocal sliders which have slide pins 12M (12N) formed thereon. The side frames 10B(10C) in which slots 10D(10E) are formed, are also formed with vertically extending shift slots 10J(10K). These shift slots 10J(10K) are arranged to slidably receive guide pins 18A, 18B (16A, 16B) which are formed on carrier side plates 18(16). The shift slots 10J(10K) are arranged beside the cylindrical cams 44(46) in a manner wherein the slide pins 12M(12N) can become operatively engaged with the helical grooves 44A(46(A)).

The slots 10D(10E) are formed with branches 10D1(10E1) in a manner similar to that of the first embodiment. These branch slots are provided with corresponding guide rails 70, each comprised of front and rear sections 70A and 70B. As in the previous embodiment, both the side frames 10B and 10C are provided with the slide rails.

In the second embodiment, only a single slider 72C is reciprocatively disposed in the sliders. This single element is formed with a vertically extending groove 72D in which the pins 12G(12H) can be received. The sliders 72 are directly connected with a crank wheel 74 by way of links 76. As shown, each link is connected to a crank wheel 74 by way of pin 74A and to a slider 72 by way of a pin 72C2.

It will be kept in mind that the tray shift pins 12M which are engageable in the helical grooves 44A(46A) are formed on members which can slide along the guide flanges 12K(12L). In this embodiment, rotation of the crank wheel 74 is such as to draw the sliders 72 back along the slide rails 70 in the manner illustrated in FIG. 14. This movement pulls the pins 12G(12H) rearwardly along with the sliders 721C. Even though the shift pins 12M(12N) are retained in the grooves 10J(10K), the rearward movement of the tray 12 is permitted by the sliding action of the members on which the shift pins 12M(12N) are formed, along the flanges 12K(12l). Subsequent rotation of the crank wheel 74 pushes the tray back to a position wherein tray shifting can take place and the next tray be positioned for retraction.

With this second embodiment, the above described tray drawing mechanism eliminates the need to provide it between the cylindrical cams 44(46) and the side frames 10B(10C) and further enables the simplification that only one slider 72C and link 76A are required. Additionally, it is not necessary to locate the cams carefully with respect to the branch slots 10D1.

THIRD EMBODIMENT

Figure 15:
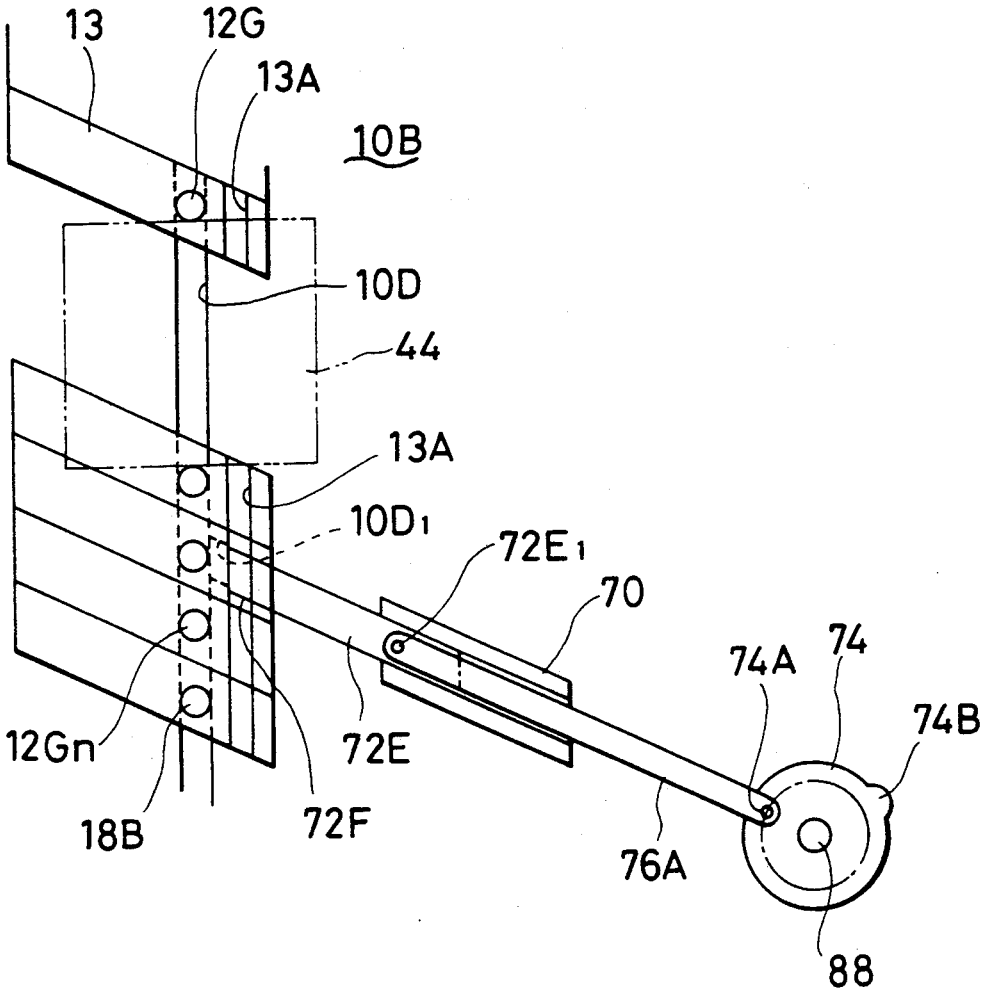
FIGS. 15 and 16 are views which show the construction and operation of a third embodiment of the present invention.
Figure 17:
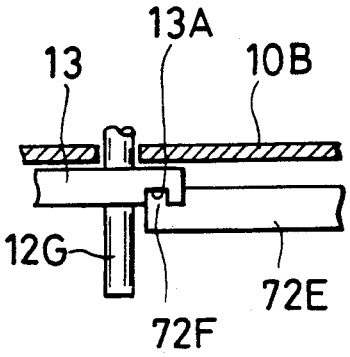
FIG. 17 is a view as seen in the direction of arrow P in FIG. 16.
Figure 16:
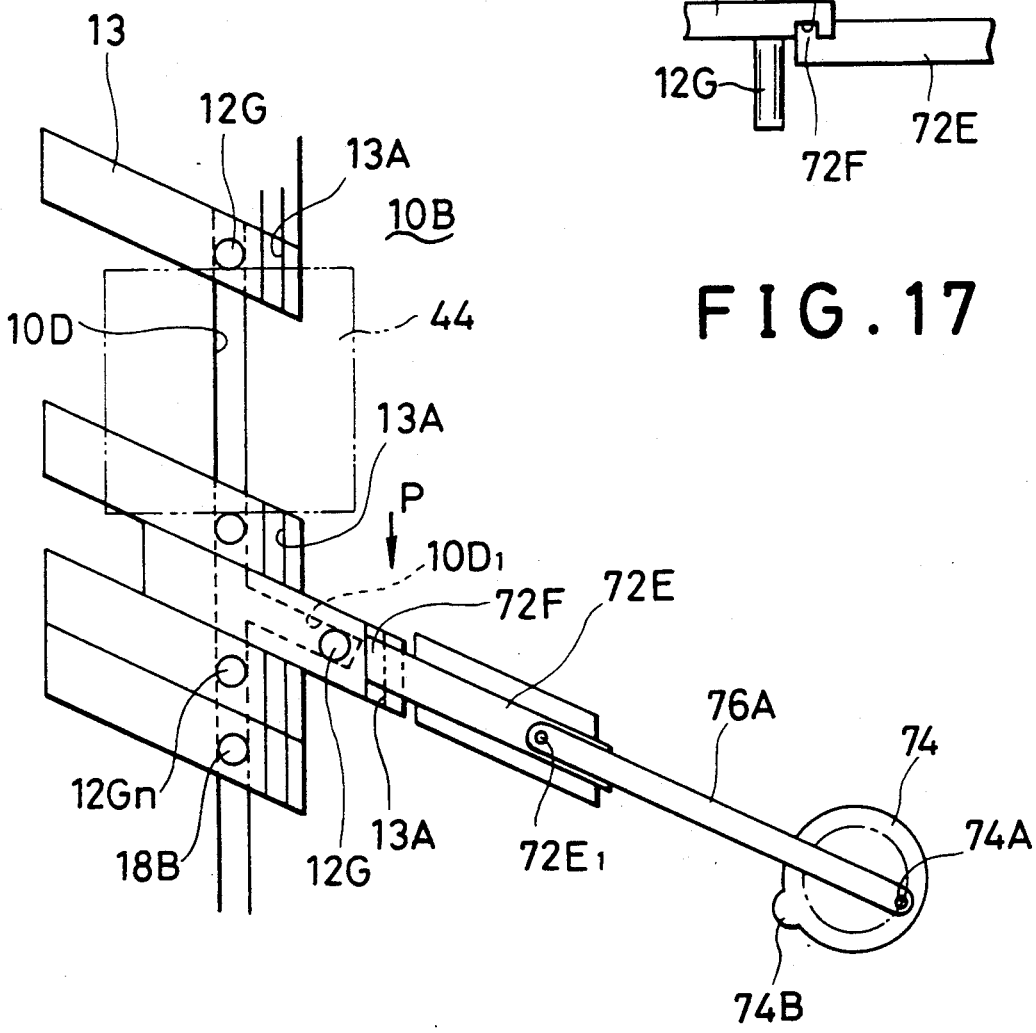

FIGS. 15 to 17 show a third embodiment of the present invention. This embodiment also features a simplified tray drawing mechanism. In this embodiment also, like elements are denoted by like numerals.

In this arrangement the tray pins 12G(12H) and guide pins 18A, 18B (16A, 16B) of the carrier side plates 18(16) are arranged to pass through spacers 13 (see FIG. 17). The spacers 13 are each formed with grooves 13A into which a hook member can be slidably received.

Slide rails 70 is fixedly connected to the side frames 10B(10C) in a manner to be aligned with the branch slots 10D1(10E1). In other words aligned with the extrapolation of the branch slots.

Sliders 72E are reciprocatively received in the guide rails to. Each slider has a hook 72F and the end thereof which can be received in the above mentioned hook receiving grooves 13A. Each of the sliders 72 are operatively connected with a crank wheel 74 by way of a link 76A.

When the crankwheel 74 is rotated through the first 180 degress the spacers 13 which are currently held in the positions wherein the hooks 72F engage in the grooves 13A of the same, the spacer 13 slides from the position shown in FIG. 15 to that shown in FIG. 16. In the latter mentioned position the sheets on the tray associated with the sliders are located in the stapler as in the case of the previous embodiments. The subsequent 180 degrees of rotation moves the sliders back into alignment with the others. Rotation of the cams 44(46) shifts the trays in a manner the hooks 72F at the ends of the sliders enter the grooves 13A on the next spacers 13.

With this embodiment the need to provide two guide slots such as used in the second embodiment is eliminated. In addition no special relationship between the tray which is being tracted to the stapler and the position of the cylindrical cams is required.

It will be appreciated that it is possible to install devices which enable to apply adhesive at the edges of a stack of sheets so as to fasten the same instead of a stapler.

The present invention has been described in detail with respect to preferred embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

What is claimed is:

1. A sorter comprising:

a plurality of trays which are arranged in a vertical direction which can be selectively shifted by means of cylindrical cams substantially vertically and maintained in a predetermined position wherein sheets can be received, said cylindrical cams each having a helical groove which has an inclination at a predetermined angle;

means for ejecting sheets onto the tray in said predetermined position;

means for selectively diagonally drawing one of said plurality of trays along said inclination of said helical groove to an operative position; and fastening means disposed with respect to said operative position for fastening a stack of sheets which have been accumulated on the diagonally drawn tray.

2. A sorter as claimed in claim 1 wherein said fastening means comprises a stapler.

3. A sorter as claimed in claim 2 wherein each of said trays comprises:

a cut-out formed in a corner of the tray;

a rear wall which extends up at a rear edge of the tray and which terminates at said cut-out;

a first side wall which extends up at a first side edge of the tray, which is perpendicular to said rear wall and which terminates at said cut-out, and wherein each of said trays is oriented in a manner wherein the corner in which the cut-out is formed is lower than the other corners thereof.

4. A sorter as claimed in claim 1 wherein said tray drawing means comprises:

a frame member formed with a branch slot which merges with a vertically extending guide slot;

a guide rail which is mounted on said frame member in a predetermined relationship with the branch slot;

a slider arrangement which is reciprocatively received in said guide rail and arranged to engage a selected one of a plurality of guide pins which are formed on said plurality of trays respectively; and means for moving the slider along said guide rail.

5. A sorter comprising:

a plurality of trays which are arranged in a vertically array which can be selectively shifted to and maintained in a predetermined position wherein sheets can be received;

means for ejecting sheets onto the tray in said predetermined position;

means for fastening stacks of sheets which have accumulated on said trays comprising a stapler; and means for selectively drawing one of said plurality of trays to an operative position with respect to said fastening means, wherein each of said trays comprises a cut-out formed in a corner of the tray;

a rear wall which extends up at a rear edge of the tray and which terminates at said cut-out;

a first side wall which extends up at a first side edge of the tray, which is perpendicular to said rear wall and which terminates at said cut-out, and wherein each of said trays is oriented in a manner wherein the corner in which the cut-out is formed is lower than the other corners thereof, and a second side wall which extends from a second side edge of each tray, said second side wall having a height which is greater than the first side wall and extending in a direction which is opposite to the direction in which said first side wall extends, said first and second side walls having horizontally extending guide pins which extend from rear portions thereof, said second side wall having a second horizontally extending guide pin proximate a forward position thereof.

6. A sorter as claimed in claim 5 further comprising:

a frame member;

vertically extending guide slots in said frame, said guide slots reciprocatively receiving the guide pins which extend from the rear portions of said first and second side walls;

first and second vertically extending shafts which are rotatably supported on said frame member;

first and second cams in which helical grooves are formed, said first and second cams being respectively mounted on said first and second shafts and arranged so that the guide pins which extend from the rear portions of the first and second side walls can be operatively engaged in the helical grooves; and means for driving said first and second cams in opposite rotational directions.

7. A sorter as claimed in claim 6 wherein the guide pin which extends from the rear portion of said second guide wall is located proximate the lower edge thereof, and wherein said first and second cams are arranged at different heights.

8. A sorter as claimed in claim 7 further comprising a transfer roller and a pinch roller, said transfer roller and pinch roller being rotatably supported on first transfer roller shaft and a pinch roller shaft respectively, said transfer roller shaft and said pinch roller shaft being arranged to extend laterally across the frame member at a predetermined angle with respect to the horizontal.

9. A sorter as claimed in claim 8 wherein said tray drawing means comprises:

a branch slot which is formed in said frame member and which merges with the vertically extending guide slot and which is arranged at a predetermined angle;

a guide rail which is supported on said frame member and which is arranged in a predetermined relationship with respect to said branch slot;

a slider which is reciprocatively disposed in said guide rail and engageable with the guide pins which are reciprocatively received in said guide slot;

means for moving said slider along said guide slot.

10. A sorter as claimed in claim 9 wherein said first and second cams have a cylindrical configuration and are each formed with a helical groove which winds about the periphery of the cam twice, the lower first winding of each groove having the same inclination as the angle at which the branch slot merges with the vertically extending guide slot.

11. A sorter as claimed in claim 10 wherein an extrapolation of the axis of the branch groove extends to an entrance of the stapler.

12. A sorter as claimed in claim 10 wherein said slider moving means comprises:

a crank wheel;

a link which is pivotally connected at a first end to said crank wheel and at a second end to said slider arrangement.

13. A sorter comprising:

a plurality of trays which are arranged one above the other and which are vertically displaceable, each of said trays including:

a rear wall, a first side wall, a cut-out formed at the corner toward which said rear and first side wall extend, a second side wall which has a height greater than that of the first side wall and which extends in a direction opposite that of the first side wall, first and second horizontally extending guide pins, said first guide pin being arranged to project from said first side wall at location proximate a rear edge thereof and proximate the cut-out, the second pin extending from said second side wall at locations proximate a rear edge thereof, first and second guide flanges, formed on said first and second side walls respectively, and first and second shift pins slidably mounted on said first and second guide flanges;

a frame member, said frame member being formed with:

a pair of first guide slots which are essentially vertical and in which the guide pins are received, a pair of branch slot which merges with the first guide slots at a predetermined angle, and a pair of second guide slots which are essentially vertical and in which said shift pins are received;

first and second cylindrical cams respectively mounted on first and second vertical shafts, the first and second vertical shafts being rotatably mounted on said frame member, said first and second cylindrical cams being formed with helical grooves in which the shift pins can engage;

a pair of guide rails disposed on said frame member in a predetermined relationship with said branch slots;

a pair of sliders disposed in said guide rails, said sliders being formed with means for engaging the tray pins; and means for selectively moving said sliders along said guide rails.

14. A sorter as claimed in claim 13 wherein said means for selectively moving said slider comprises:

a crankwheel; and a link operatively interconnecting said slider and said crankwheel.

15. A sorter as claimed in claim 14 further comprising a stapler, said stapler having an entrance which is located on an extrapolation of the branch slot.

16. A sorter comprising:

a plurality of trays which are arranged one above the other and which are vertically displaceable, each of said trays including:

a rear wall, a first side wall, a cut-out formed at the corner toward which said rear and first side wall extend, a downwardly extending second side wall which has a height greater than that of the first side wall, first and second horizontally extending tray pins, said first tray pin being arranged to project from said first side wall at location proximate a rear edge thereof and proximate the cut-out, the second pin extending from said second side wall at locations proximate a rear edge thereof, first and second spacers, said spacers being formed with vertical extending grooves and holes through which the first and second tray pins are received;

a frame member, said frame member being formed with:

a pair of first guide slots which are essentially vertical and in which said tray pins are received, and a pair of branch slots which merge with the first guide slots at a predetermined angle;

first and second cylindrical cams respectively mounted on first and second vertical shafts, the first and second vertical shafts being rotatably mounted on said frame member, said first and second cylindrical cams being formed with helical grooves in which said tray pins can engage;

a pair of guide rails disposed on said frame member in a predetermined relationship with said branch slots;

a pair of slide members which are formed with hook portions and which are reciprocatively received in said guide rails, the hook portions being arrange to be engageable with said vertical extending grooves formed in the spacers; and means for moving the slide members along said guide rails.

17. A sorter as claimed in claim 16 wherein said slide member moving means comprises:

a crankwheel; and a link operataively interconnecting said crankwheel and said slide member.

18. A sorter as claimed in claim 17 further comprising a stapler, said stapler having an entrance which is located on an extrapolation of the branch slot.

* * * * *